United States Patent [19]

Phipps

[11] Patent Number: 4,781,055

[45] Date of Patent: Nov. 1, 1988

[54] CRIMPING MACHINE

[75] Inventor: Wendle R. Phipps, Saginaw, Tex.

[73] Assignee: Stratoflex, Inc., Fort Worth, Tex.

[21] Appl. No.: 53,580

[22] Filed: May 22, 1987

Related U.S. Application Data

[63] Continuation of Ser. No. 799,141, Nov. 18, 1985, abandoned, which is a continuation-in-part of Ser. No. 722,290, Apr. 11, 1985, abandoned.

[51] Int. Cl.[4] ..... B21D 39/04; B21D 41/02

[52] U.S. Cl. ..... 72/402; 29/237

[58] Field of Search ..... 72/402, 393, 452, 481, 72/413, 456, 446; 100/226; 29/237, 282

[56] References Cited

U.S. PATENT DOCUMENTS

| | | | |
|---|---|---|---|
| 2,115,719 | 5/1938 | Holm et al. | 100/226 |
| 2,270,817 | 1/1942 | Allen | 100/226 |
| 2,756,620 | 7/1956 | Daniels | 72/481 |
| 2,999,405 | 9/1961 | Ewart | 72/402 |
| 3,093,182 | 6/1963 | Vanderhoof | 72/402 |
| 3,119,728 | 1/1964 | Janapol | 100/226 |
| 3,851,514 | 12/1974 | Chen et al. | 72/402 |
| 4,034,592 | 7/1977 | Chen et al. | 72/402 |
| 4,034,593 | 7/1977 | Patel . | |
| 4,309,892 | 1/1982 | Currie | 72/402 |
| 4,515,006 | 5/1985 | Stanley | 72/402 |

FOREIGN PATENT DOCUMENTS

| | | | |
|---|---|---|---|
| 0147971 | 7/1985 | European Pat. Off. . | |
| 584187 | 9/1933 | Fed. Rep. of Germany | 72/452 |
| 2159885 | 12/1975 | Fed. Rep. of Germany . | |
| 252447 | 5/1926 | United Kingdom | 72/452 |

*Primary Examiner*—Daniel C. Crane

*Attorney, Agent, or Firm*—Marshall, O'Toole, Gerstein, Murray & Bicknell

[57] ABSTRACT

This disclosure relates to a machine for attaching a fitting to a length of hose by crimping. The machine comprises a base plate and a die set which is positioned on and supported by the base plate. A power unit is mounted above the base plate and the die set, the unit including a movable ram and a ram extension which is pivotably connected to the ram. A die bowl is positioned over the die set, and the power unit is operable to drive the ram extension against the die bowl, this action crimping a fitting positioned in the die set. The ram extension is attached to the ram for pivotal movement on an axis that is perpendicular to the ram movement, so that the extension is movable up and away from the die set. The die set includes a die plate and die segments on the plate, and the die bowl is positioned around the segments. The die bowl is separable from the die set, and a spacer ring is attachable to the bowl to achieve different crimp diameters for a given die set. The die segments are mounted on the die plate for radial movement.

11 Claims, 4 Drawing Sheets

10
11
12
13
14
17
19
31
32
33
34
38
39
41
45
46
47
48
49
68
69
71
72
73
81
82
83
86
87

CRIMPING MACHINE

This application is a continuation of application Ser. No. 799,141, filed Nov. 18, 1985, now abandoned, which is a continuation-in-part of Ser. No. 722,290, filed Apr. 11, 1985, now abandoned.

FIELD AND BACKGROUND OF THE INVENTION

This invention relates to a crimping machine for assembling a hose and a fittinq.

Numerous designs of crimping machines have been marketed in the past and described in patents for assembling a length of hose with a metal fitting. The fitting is the type including an internal member or nipple and an external member or socket, and an end portion of the hose is positioned between the socket and the nipple. The crimping machine is then operated to deform the socket radially inwardly and thereby grip the hose between the socket and the nipple.

Generally, such a crimping machine includes a set of angularly spaced die segments which are radially movable, and a drive or power unit which operates to force the segments radially inwardly and thereby compress the socket. Usually such crimping machines are relatively large and are operated in factories, but smaller machines have also been available for use at job sites or other field locations.

The present invention deals with a simplified machine which is particularly suited for use as a relatively small machine usable in the field. In such a machine it is important that the power unit have a relatively short power stroke, that the die set be easily accessible for mounting the hose and fitting in the machine, and that the machine be easily adjustable to different crimp diameters and have a short setup time.

It is a primary object of this invention to provide an improved machine which meets the foregoing requirements.

BRIEF SUMMARY OF THE INVENTION

A machine in accordance with this invention comprises a base plate and a die set which is positioned on and supported by the base plate. A power unit is mounted above the base plate and the die set, the unit including a movable ram and a ram extension which is pivotably connected to the ram. A die bowl is positioned over the die set, and the power unit is operable to drive the ram extension against the die bowl, this action crimping a fitting positioned in the die set.

The ram extension is attached to the ram for pivotal movement on an axis that is perpendicular to the ram movement, so that the extension is movable up and away from the die set. The die set includes a die plate and die segments on the plate, and a die bowl is positioned around the segments. The die bowl is separable from the die set, and a spacer ring is attachable to the bowl to achieve different crimp diameters for a given die set. The die segments are mounted on the die plate in an improved manner.

BRIEF DESCRIPTION OF THE DRAWINGS

The foregoing objects and advantages will become better understood from the following detailed description taken in conjunction with the accompanying figures of the drawings, wherein.

DETAILED DESCRIPTION OF THE DRAWINGS

While the following description includes such relative terms as top, lower, front, etc., it will be understood that these terms are used only to facilitate the description of the parts during normal use, and should not be considered as limiting the machine to any particular orientation.

Figure 2:
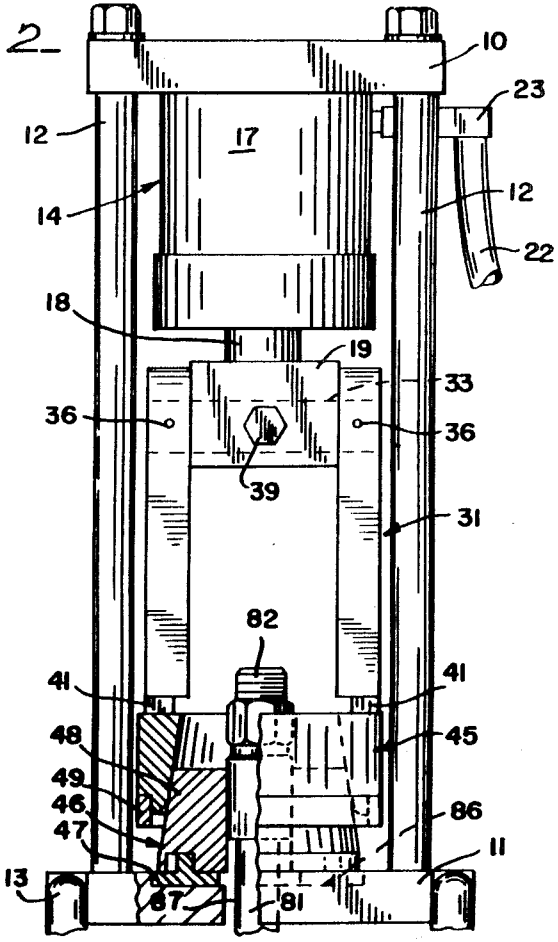
FIG. 2 is an elevational view partially in section of the machine.
Figure 1:
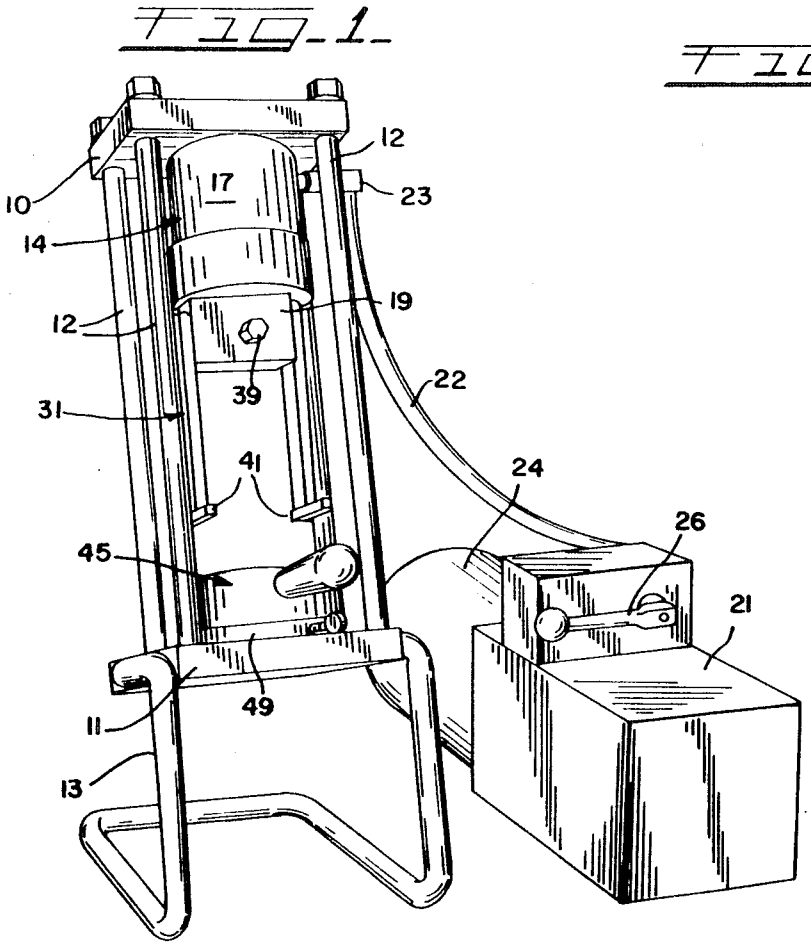
FIG. 1 is a perspective view illustrating a machine in accordance with the present invention.
Figures 3, 4, 5:
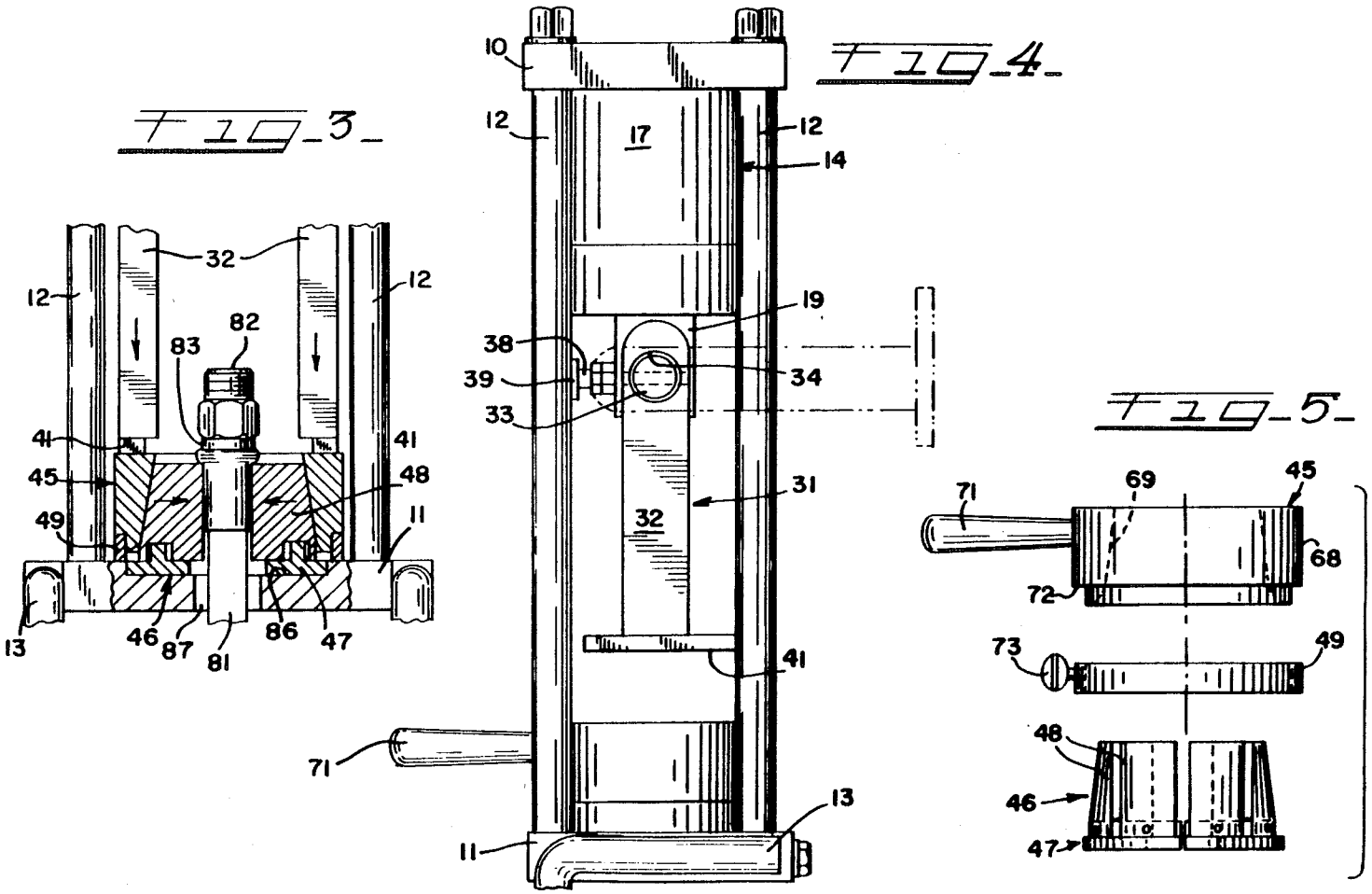
FIG. 3 is a fragmentary view illustrating the operation of the machine.
FIG. 4 is a view similar to FIG. 2 but showing a side view of the machine.
FIG. 5 is an exploded view showing a die set of the machine.

A preferred embodiment of the invention is illustrated in the drawings and, with particular reference to FIG. 1, 2 and 4, comprises a top plate 10, a bottom or base plate 11 and four tie rods 12 which hold the two plates 10 and 11 in fixed spaced-apart relation with their planes substantially parallel to each other. As shown, for example, in FIG. 1, the two plates 10 and 11 are substantially square and one of the tie rods 12 is located adjacent each corner of the squares. The lower or base plate 11 is mounted on a stand 13 which holds the plate 11 spaced upwardly above a suitable supporting platform, not shown. The stand 13 is preferably constructed so that the upper part of the machine is tilted rearwardly as shown in FIG. 1 to provide better access to the machine parts from the front of the machine and to allow a length of hose to curve downwardly and forwardly from the base plate as will be described.

The machine further comprises a power unit 14 which is mounted on the top plate 10 and extends between the two plates 10 and 11. The power unit 14 comprises a hydraulic cylinder 17 secured to the underside of the top plate 10 and a ram or piston rod 18 (FIG. 2) that extends axially and into the lower end of the cylinder 17. Secured to the lower end of the ram 18 is a crossbar 19. When the cylinder 17 is actuated, internal pressure within the cylinder forces the ram 18 downwardly toward the base plate 11 along the axis of the machine, this axis being defined herein as being along the axis of the ram 18 and its direction of movement and being perpendicular to the planes of the two plates 10 and 11. The axis of the machine also extends substantially through the centers of the two plates 10 and 11 and parallel to the tie rods.

To operate the power unit 17, a hydraulic pump 21 is connected by a hose 22 and a coupling 23 to the cylinder 17. An electric motor 24 is connected to operate the pump 21 and a control handle 26 controls energization of the pump 21. The motor-driven pump 21 may, as a specific example, be a 3,000 p.s.i. hydraulic power unit.

The power unit 14 further comprises a ram extension 31 including two laterally spaced-apart legs 32 secured to opposite ends of a pivot shaft 33 (FIGS. 2 and 4). The shaft 33 extends through a laterally extending cylindrical opening 34 formed in the crossbar 19, and the two legs 32 are secured to the opposite ends of the shaft 33 by pins 36. The shaft 33 is rotatable within the opening 34 on a horizontal, laterally extending axis, but may be held in either an extended position shown in full lines in FIGS. 2 and 4 or in a retracted position shown by dash-dot lines in FIG. 4. To hold the legs 32 in either of its two positions, a spring-loaded pin 38 is mounted in a hole formed in the crossbar 19 and its inner end is adapted to extend into one of two detents (not shown) formed in the shaft 33. As shown in FIGS. 2 and 4, the outer end of the pin 38 includes a head 39 which extends toward the front of the machine from the front surface of the crossbar 19, and one of the two detents is located such that it is engageable by the pin when the shaft 33 and the legs 32 are in the extended position shown in FIG. 2 wherein the legs are parallel to the axis of the machine. The other of the two detents is located such that it is engageable by the pin 38 when the legs are pivoted rearwardly and upwardly to the retracted position shown in FIG. 4 wherein the legs extend substantially perpendicular to the axis of the machine. The pin 38 is urged in the direction of the shaft 33 by its spring (not shown) and into the detents. To pivot the legs rearwardly, the operator of the machine merely pulls the head 39 and the pin 38 toward the front of the machine and thereby moves the pin out of a detent in the shaft 33.

As shown in the drawings, the two legs 32 are spaced laterally of the machine and are adjacent the tie rods 12. Attached to the lower end of each leg 32 is a foot 41 which in the present example extends forwardly-rearwardly of the machine and is substantially horizontal when the legs 32 are in the extended position.

With specific reference to FIGS. 2, 3 and 5–7, the machine further comprises a die bowl 45 and a die set 46, the die set including a die retainer plate 47 and a plurality of die segments 48. As an optional element, the die bowl 45 may include a spacer ring 49 for a purpose to be described hereinafter.

Figure 6:
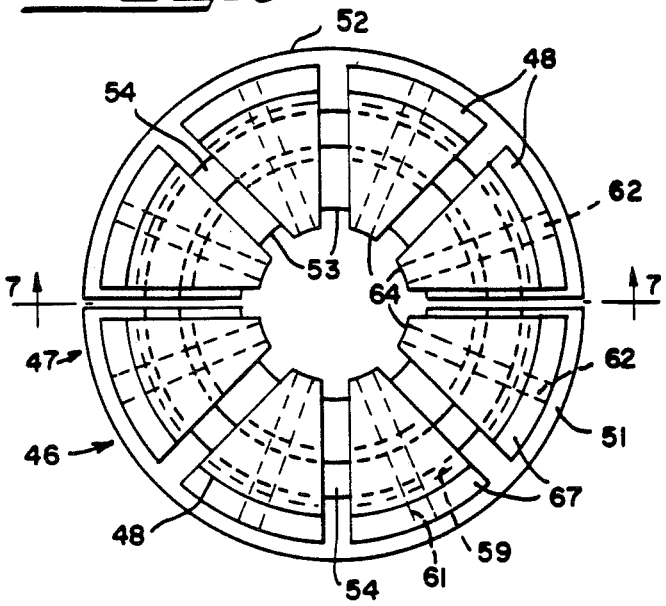
FIG. 6 is a view taken on the line 6—6 of FIG. 5.
Figure 7:
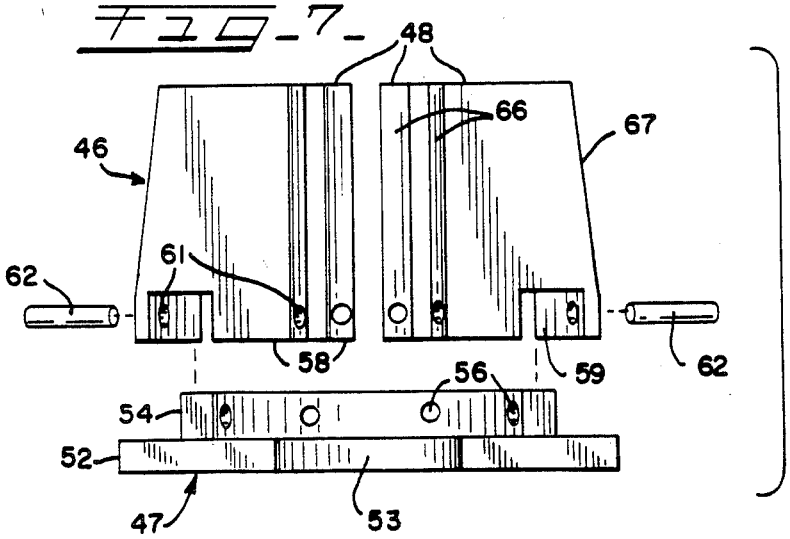
FIG. 7 is an exploded view taken on the line 7—7 of FIG. 6.

With reference to FIGS. 6 and 7, the retainer plate 47 is formed by two semi-circular sections 51 and 52, each of the sections having a semi-circular opening 53 formed at its center. An arcuate rib or ring 54 is formed on the upper surface of each section of the plate and has holes 56 extending therethrough, the holes 56 being equally spaced and extending radially. The holes 56 correspond in number to the number of the die segments 48.

There are a total of eight die segments in the illustrated form of the invention, and four segments are mounted on each section of the retainer plate. Each die segment 48 includes a flat bottom surface 58 which is positioned on the upper surface of a section of the retainer plate, and an arcuate groove 59 is formed in the under-surface 58, the groove 59 being located over the ring 54. The lower portion of each segment 48 has a radially extending hole 61 formed therethrough which is aligned with one of the holes 56 formed in the ring 54, and a radially extending hardened pin 62 is positioned through each of the holes 56 and the companion holes 61. The holes are sized relative to the pin 62 such that the segments 48 are movable in the radial direction relative to the accompanying retainer plate section, and the radial width of the groove 59 is sufficiently greater than the radial thickness of the ring 54 that the segments 48 are radially movable on the plate section between a closed position shown in FIGS. 3 and 4 and an open position shown in FIGS. 2 and 6.

As shown in FIG. 6, each of the segments 48 is pie-shaped when viewed from above and has a generally axially extending arcuate inner surface 66. The exterior or outer surface 67 of each segment is, however, slanted or tapered axially downwardly and radially outwardly to form a truncated cone as shown in FIGS. 3 and 5.

With particular reference to FIG. 5, the die bowl 45 has a cylindrical outer surface 68 and a tapered interior cam surface 69, the two surfaces 68 and 69 being substantially coaxial. The taper of the surface 69 is substantially equal to that of the outer surfaces 67 of the die segments 48 as shown in FIGS. 2 and 3. Extending radially from the front side of the bowl is a handle 71 for use by a machine operator in installing or removing the die bowl.

At the lower outer edge of the die bowl is formed an annular groove 72 which is adapted to receive the spacer ring 49 as shown in FIGS. 2 and 3. The ring 49 is adapted to be positioned in the groove and secured to the bowl by a wing screw 73 (FIG. 5) which extends through a threaded radial hole formed in the ring 49 and is engageable with the bowl 45 in order to secure the ring 49 to the bowl. The ring 49 has a greater axial dimension than the axial length of the groove 72, and its function will be explained subsequently.

FIGS. 2 and 3 show a typical hose 81 and fitting 82 which may have a conventional construction and are adapted to be assembled by the machine. The hose 81 includes, for example, an inner tube, one or two layers of wire reinforcing braid around the tube, and a cover around the exterior of the braid. The fitting 82 includes an inner member or nipple which extends into the interior of an end portion of the inner tube, and an outer sleeve or socket which is radially spaced outwardly from the nipple and is positioned around the end portion of the hose. Prior to being mounted in the machine for crimping, the socket is initially locked to the nipple at the point indicated by the reference numeral 83 (FIG. 3) and the end portion of the hose is positioned in the annular space between the nipple and the socket. It is the function of the present machine to crimp or deform the socket radially inwardly in order to compress the end portion of the hose between the nipple and the socket and thereby tightly assemble the fitting with the hose. In the use of the present machine, the outer cover of the hose is normally not removed from the end portion of the hose.

Prior to use of the machine to crimp a hose and fitting, the operator of the machine first determines the size and type of hose and fitting, positions the hose end portion within the fitting, and selects a die set for use with the particular size of hose and fitting. Normally a machine of this nature is usable with a variety of hose sizes and die sets are provided for the different hose sizes. A single die bowl 45 is used with all of the die sets, and the segments of the various die sets have the same outer surface 48 dimensions. The radial thicknesses of the segments of the various die sets are different, however, thereby forming different crimp diameters for the die sets. The spacer ring 49 is provided to enable two crimp diameters to be obtainable from a single die set, and in the present specific example of the operation of the machine, the spacer ring 49 is appropriate for the particular size and it is fastened to the lower side of the die bowl. The operator pulls the lock pin 38 and pivots the ram extension rearwardly and upwardly to the retracted position. The operator of the machine places one of the two plate sections 51 and 52 on the base plate 11, the section having the die segments thereon, of course. As shown in FIGS. 2 and 3, a counterbore 86 is formed in the upper surface of the base plate 11 on the machine axis, the counterbore 86 being sized to receive the two sections 51 and 52 of the die retainer plate. The counterbore 86 serves to properly locate the die set on the axis of the base plate and it retains the die set in the proper position. With one of the two retainer plate sections positioned toward the back of the counterbore 86, the loosely assembled hose and fitting are positioned within the interior of the jaw segments adjacent the surfaces 66. A hole 87 (FIGS. 2 and 3) is formed through the base plate 11 on substantially the axis of the machine, and the hose extends through the hole 87 and downwardly therefrom. The stand 13 is, of course, constructed to provide clearance for the hose, and the tilt of the machine formed by the shape of the stand causes the lower end of the hose to extend downwardly and forwardly so that it can be curved out of the way of the operator. Thereafter the second or front section of the retainer plate and the die segments mounted thereon are positioned in the counterbore 86 so that the major portion of the socket of the fitting is enclosed as shown in FIG. 2. Only the upper portion of the socket adjacent the lock 83 is clear of the die segments. After the die segments and the hose and fitting have been installed, the die bowl 45 is positioned over the top of the die segments, the fitting extending upwardly through the center opening of the bowl as shown in FIGS. 2 and 3. The die segments are in the open position and, as shown in FIG. 2, the cam surface 69 of the bowl is sized relative to the tapered exterior surfaces of the die segments 48 such that the bowl surrounds only the uppermost portions of the slanted surfaces of the segments.

The ram extension is then moved downwardly by first pulling the spring-loaded pin 38 forwardly, which enables the operator to move the legs 32 downwardly to their axially extended positions shown in full lines in FIG. 4. In this position the feet 41 of the ram extension are located directly above the flat upper surface of the bowl 45. The operator of the machine then, while holding the hose and the fitting in the proper position in the die set, turns the handle 26 to cause hydraulic pressure from the pump 21 to be applied to the hydraulic cylinder 17 and thereby force the ram 18 and the ram extension 31 axially downwardly toward the base plate 11 and the die bowl 45. The feet 41 engage the upper surface of the die bowl 45 and force the die bowl axially downwardly, and the tapered surfaces of the die bowl and the die segments cooperate to cam the die segments radially inwardly as shown in FIG. 3. This action compresses the socket and deforms it permanently radially inwardly in order to cause the socket and the nipple to grip the hose 81. The downward movement of the ram extension and the die bowl is continued until the lower surface of the spacer ring 49 engages the base plate 11. When the spacer ring 49 bottoms out on the base plate, the operator moves the control handle 26 to the return position causing the ram extension 31 to retract upwardly. The compressive force on the socket then relaxes and causes the die segments to shift slightly radially outwardly and pop the die bowl 45 upwardly. The die bowl may then be removed after the ram extension is again pivoted to the retracted position, and the crimped hose and fitting assembly is removed from the machine.

It should be understood that a suitable lubricant is normally applied to the surfaces of the die bowl and the die segments to reduce wear and prevent the parts from binding.

It will be apparent from FIGS. 2 and 3 that the extent of the radially inward movement of the die segments 46 and the final crimp diameter is determined by the distance that the die bowl 45 moves downwardly. To provide a two-step adjustment of this distance for a single die set, the spacer ring 49 is provided which is attachable to the bottom side of the bowl 45 as previously described. When the spacer ring 49 is attached as illustrated and described, it prevents the bowl 45 from moving all the way downwardly and engaging the upper surface of the base plate 11. With the spacer ring 49 removed, the die bowl 45 may be moved by the power unit an additional distance downwardly until it meets the base plate 11, thereby forming a smaller crimp diameter.

Figure 8:
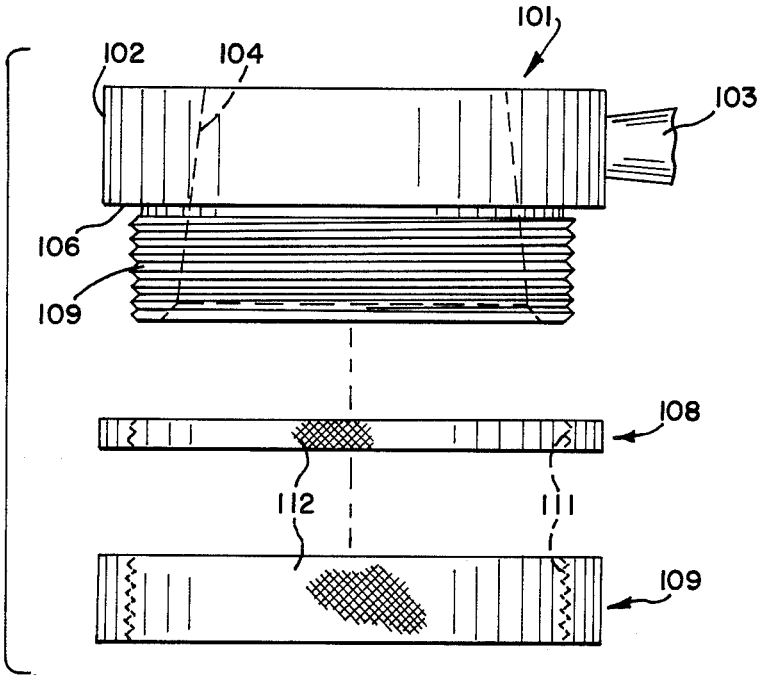
FIG. 8 is an exploded view of parts in accordance with an alternative form of the invention.
Figure 9:
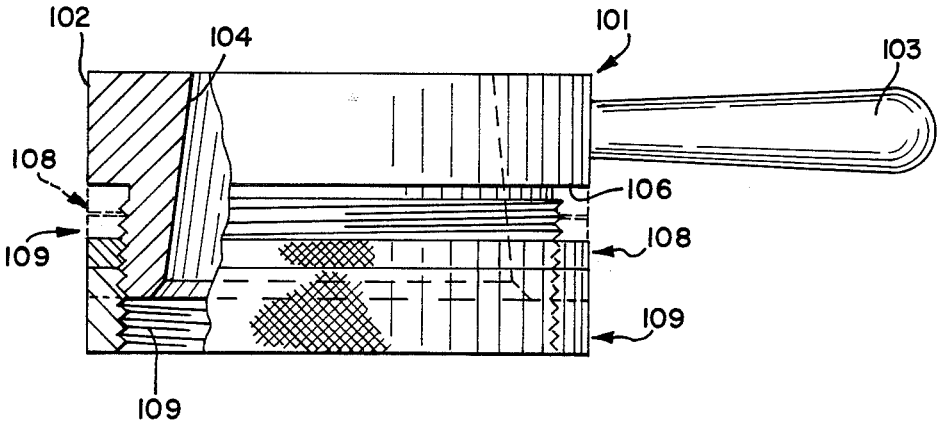
FIG. 9 is an assembled view of the parts shown in FIG. 8.

As mentioned above, the spacer ring 49 provides for a two-step adjustment of the die bowl, one existing when the ring is attached to the bowl 45 and the other existing when the ring is detached. FIGS. 8 and 9 illustrate an arrangement wherein the spacer ring permits additional degrees of adjustment.

This arrangement comprises a die bowl 101 having a cylindrical outer surface 102, a handle 103 and an interior tapered cam surface 104, similar to the die bowl 45. The outer periphery of the bowl at its lower end has a groove 106 formed on it, and exterior threads 107 are formed on the grooved part.

Also provided are a lock ring 108 and a spacer ring 109, both having interior threads 111 which are engageable with the threads 107. The outer surfaces of the rings 108 and 109 are preferably knurled as indicated by the numeral 112. When in use, the two rings 108 and 109 are threaded on the die bowl 101 with the block ring 108 above the spacer ring 109 as shown in FIG. 9. The spacer ring may be threaded to a desired position on the die bowl and then locked in the selected position by tightening the lock ring against it.

Consequently the spacer ring 109 may have a large number of positions on the die bowl. When the overall vertical length of the die bowl assembly (the die bowl plus the spacer ring and the lock ring) is increased by screwing the spacer ring 109 downwardly, the final crimp diameter is increased. Conversely, when the vertical length of the assembly is decreased, the final crimp diameter is decreased.

In the specific example illustrated in FIGS. 8 and 9, the vertical dimensions of the two rings 108 and 109 are sized so that the lower edge of the spacer ring 109 is substantially flush with the lower edge of the die bowl when the two rings 108 and 109 are screwed upwardly to their uppermost positions (shown in dashed lines in FIG. 9). Consequently the rings need not be removed but instead may be screwed all the way up when the smallest crimp diameter is desired. This feature is advantageous because the rings 108 and 109 may always be retained on the die bowl, thereby avoiding the chance that the rings may be misplaced.

A crimp machine constructed and operated as described has numerous advantages. The ram extension enables a type of hydraulic cylinder to be used which has a short stroke, thereby reducing the size of the machine and its cost, as well as making the operation faster. The extension is permanently attached to the ram (it is not a separate part required to be handled), and it provides full access to the die set work area when it is in the retracted position. The arrangement of the two spaced legs of the extension provides clearance for bent tube type fittings which extend upwardly from the die bowl.

The die set is readily installed in the machine, and since it is in two independent sections, it simplifies the positioning of the hose and fitting. The counterbore of the base plate, of course, locates and retains the die set. An important feature is that the die segments are stationary on the base plate (except for the radial movement during crimping) and are not mounted for movement with the ram, because this feature simplifies the mounting of the segments on the retainer plate.

A single die bowl is usable with all of the die sets, and the spacer ring, when used, is carried by the bowl (and therefore is not a separate part to be handled).

The foregoing features combine to form a crimp machine which has a relatively small size and cost, simplified construction and fast set-up time.

I claim:

1. A machine for assembling a hose and fitting by crimping, comprising a base plate, a power unit connected to said base plate, said unit including a ram which is movable on a ram axis toward and away from said base plate, a die set movably positioned on said base plate during operation of the machine, the dies of said set being movable radially but immovably axially relative to said ram axis, a die bowl movably positioned on said die set, said die bowl and said die set having cooperating cam surfaces thereon, and two extensions attached to said ram, single point means pivotably connecting said extensions to said ram whereby said extensions are pivotable together relative to said ram on a single pivot axis which is perpendicular to said ram axis and said extensions are pivotable between an extended position where they are substantially parallel with said ram axis and a retracted position where they are at an angle with said ram axis, said extensions engaging said die bowl when said ram is moved toward said base plate, and said extensions being separate and spaced from said die bowl and said die set when said ram is moved away from said base plate, said die set further including a retainer plate and said dies being movably mounted on said retainer plate, means for interconnecting said dies with said retainer plate and limiting said movement of said dies to movement in the radial direction, said retainer plate being removably positioned on said base plate, and locating means for interconnecting said retainer plate with said base plate and locating said dies concentically around said ram axis.

2. A machine as in claim 1, and further comprising means engageable with said ram and with said extensions for selectively holding said extension in one of said extended and retracted positions.

3. A machine as in claim 1, wherein said single pivot means comprises a pivot pin which is fastened to said ram on said pivot axis, and said extensions comprise spaced apart parallel legs attached to opposite ends of said pin and extending perpendicular to said pivot axis.

4. A machine according to claim 1, wherein said means for interconnecting comprises a mounting pin on said retainer plate for each of said dies, said mounting pins extending radially of said ram axis and said dies being movably mounted on said pins, said die bowl being positioned around said dies and being engageable by said ram means.

5. A machine as in claim 4, wherein said retainer plate and said dies comprise two similar independent sections.

6. A machine as in claim 1, wherein said locating means comprises a counterbore formed in said base plate and said retainer plate is positioned in said counterbore.

7. A machine for assembling a hose and fitting by crimping, comprising a base plate, a power unit connected to said base plate, said unit including ram means which is movable on a ram axis toward and away from said base plate, a die set positioned on said base plate during operation of the machine, a die bowl positioned on said die set, said die bowl and said die set having cooperating cam surfaces thereon, said die set including a retainer plate engageable with said base plate adjacent said ram axis and a plurality of die segments on said retainer plate, a mounting pin on said retainer plate for each of said die segments, said mounting pins extending radially of said axis and said die segments being movably mounted on said pins, said die bowl being positioned around said segments and being engageable by said ram means, said retainer plate comprising a substantially flat annular portion and a ring portion on one side thereof, each of said die segments comprising a substantially flat side positioned against said one side of said annular portion, said flat side having a groove therein which receives said ring portion, and said radially extending pins extending through each of said die segments and ring portion and attaching said segments to said plate.

8. A crimping machine for assembling a hose and a fitting by crimping the fitting onto the hose, comprising (a) a base plate having a central opening therein, front, back and lateral sides;

(b) a power unit positioned above said base plate and support means extending between said power unit and said base plate for supporting said power unit, said support means being along said lateral sides;

(c) said power unit including a ram which is movable on a ram axis toward and away from said base plate;

(d) a pivot pin rotatably mounted on said ram and forming a pivot axis which is perpendicular to said ram axis and which extends between said lateral sides;

(e) two extensions fastened to said pivot pin on opposite sides of said ram, each of said extensions being between said ram and one of said lateral sides, said pin and said extensions being pivotable on said pivot axis between an extended position where said extensions are substantially parallel with said ram axis and a retracted position where said extensions extend toward said back side and between said support means;

(f) a die set mounted on said base plate and around said central opening, said die set including a plurality of die segment which are movable radially of said central opening;

(g) and an annular die bowl removably positioned on said die set, said die bowl and said die set having cooperating tapered surfaces for moving said die segments radially inwardly when said die bowl is moved toward said die set and said base plate;

(h) said extensions when in said extended position being movable by said ram into and out of engagement with said die bowl, and said die bowl being removable from said die set when said extensions are in said retracted position.

9. A crimping machine as in claim 8, wherein said die set further comprises a retainer plate formed by two semicircular sections positioned around said central opening, said retainer plate being removably mounted on said base plate and said segments being fastened to said sections.

10. A crimping machine as in claim 8, and further including a releasable lock between said pivot means and said ram for holding said extensions in said retracted position, and feet on the lower ends of said extensions for engaging said die bowl.

11. A crimping machine as in claim 8, and further including an annular spacer ring removably fastened to said die bowl, said ring being movable with said die bowl and extending downwardly from said die bowl for engagement with said base plate.

* * * * *